US005163391A

United States Patent [19]

Green et al.

[11] Patent Number: 5,163,391

[45] Date of Patent: Nov. 17, 1992

[54] WEAR RESISTANT CAST IRON ROCKER ARM AND METHOD OF MAKING SAME

[75] Inventors: Keith Green, Amherst; James W. Cree, Milford, both of N.H.

[73] Assignee: Hitchiner Manufacturing Co., Inc., Milford, N.H.

[21] Appl. No.: 871,480

[22] Filed: Apr. 21, 1992

Related U.S. Application Data

[62] Division of Ser. No. 569,292, Aug. 17, 1990, Pat. No. 5,113,924.

[51] Int. Cl.[5] ..... F01L 1/18

[52] U.S. Cl. ..... 123/90.39; 123/90.51

[58] Field of Search ..... 123/90.39, 90.51; 74/519, 559

[56] References Cited

U.S. PATENT DOCUMENTS

| | | | |
|---|---|---|---|
| 3,690,958 | 9/1972 | Thompson | 123/90.39 |
| 4,147,074 | 4/1979 | Noguchi et al. | 123/90.39 |
| 4,438,738 | 3/1984 | Kosuda et al. | 123/90.39 |
| 4,870,931 | 10/1989 | Nakamura et al. | 123/90.51 |
| 4,873,150 | 10/1989 | Doi et al. | 123/90.39 |
| 5,035,959 | 7/1991 | Ito et al. | 123/90.51 |

*Primary Examiner*—E. Rollins Cross
*Assistant Examiner*—Weilun Lo
*Attorney, Agent, or Firm*—Flynn, Thiel, Boutell & Tanis

[57] ABSTRACT

A wear-resistant cast iron rocker arm or similar machine element is formed by differential pressure, countergravity casting an iron melt of low superheat into a ceramic investment shell mold maintained initially at room temperature and rapidly solidifying the melt therein to provide a wear-resistant, as-cast microstructure throughout the body of the element. The as-cast microstructure comprises a dendritic constituent of austenite or transformed austenite (e.g., pearlite) depending on alloy composition and an interdendritic carbide constituent. Interdendritic ledeburite will also be present if the austenite remains untransformed. The as-cast microstructure of the rocker arm is devoid of graphite.

8 Claims, 6 Drawing Sheets

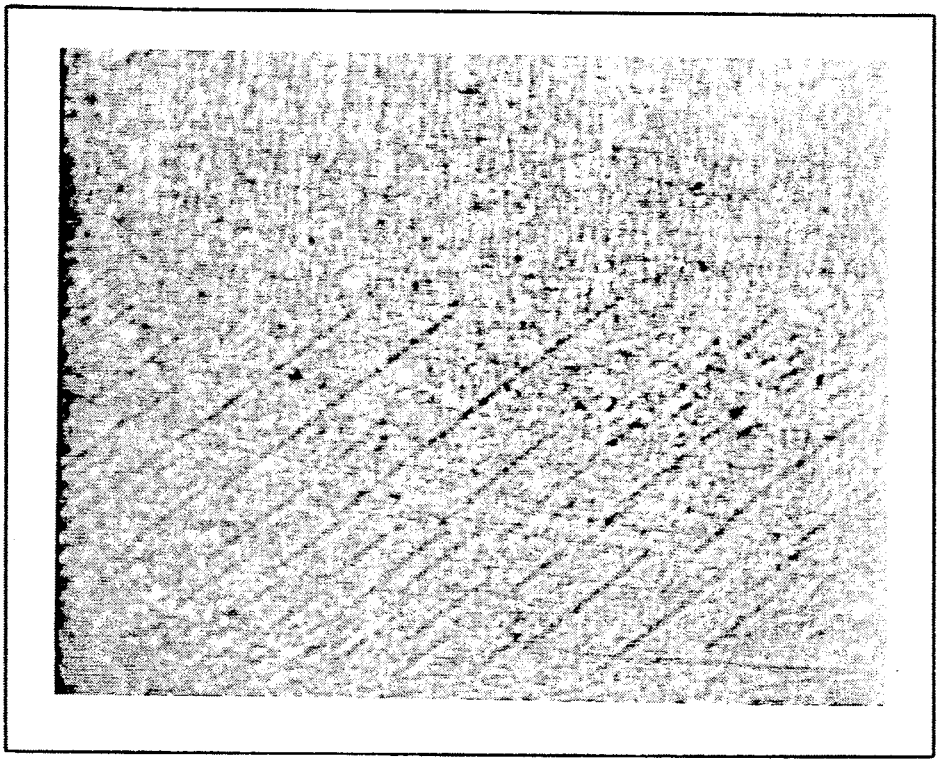
Fig-4 PRIOR ART
Fig-5 PRIOR ART
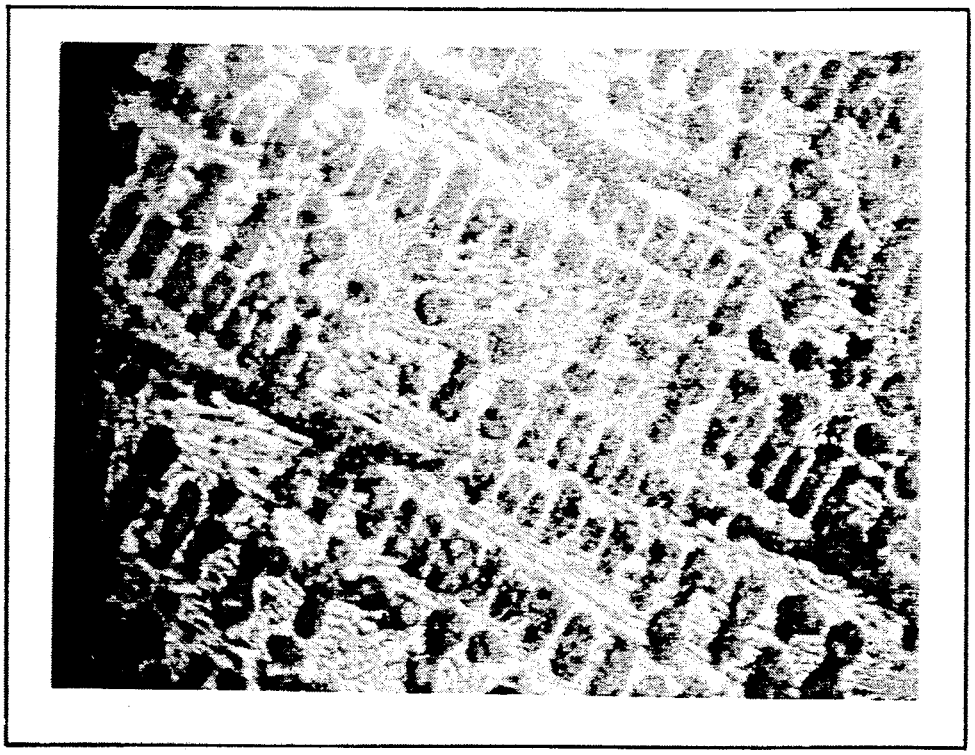

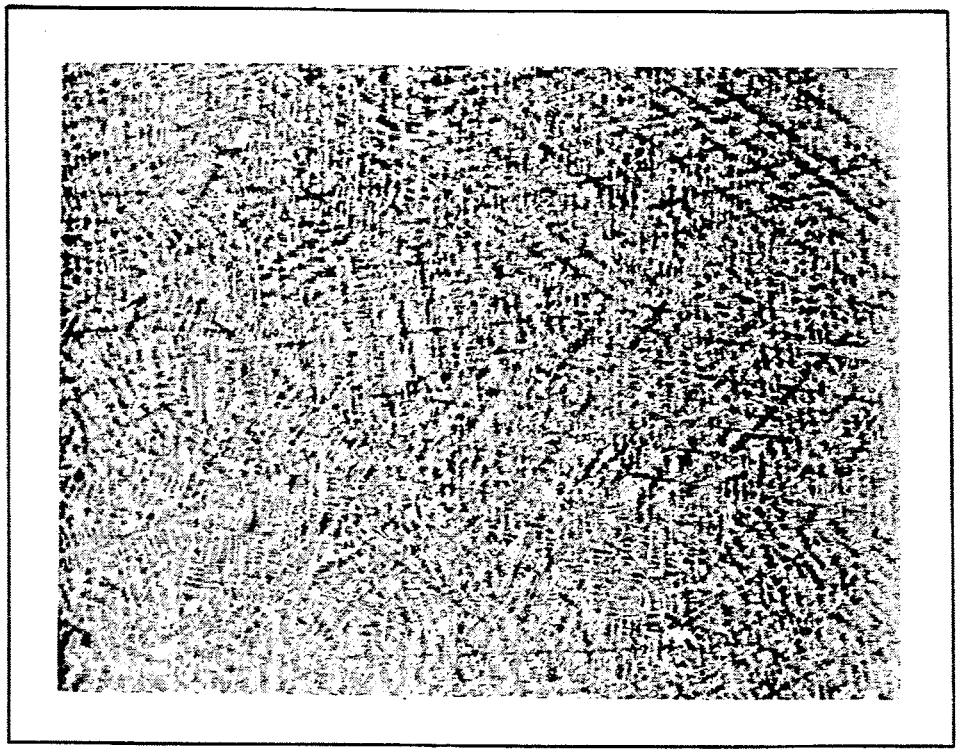
Fig - 9
Fig - 10
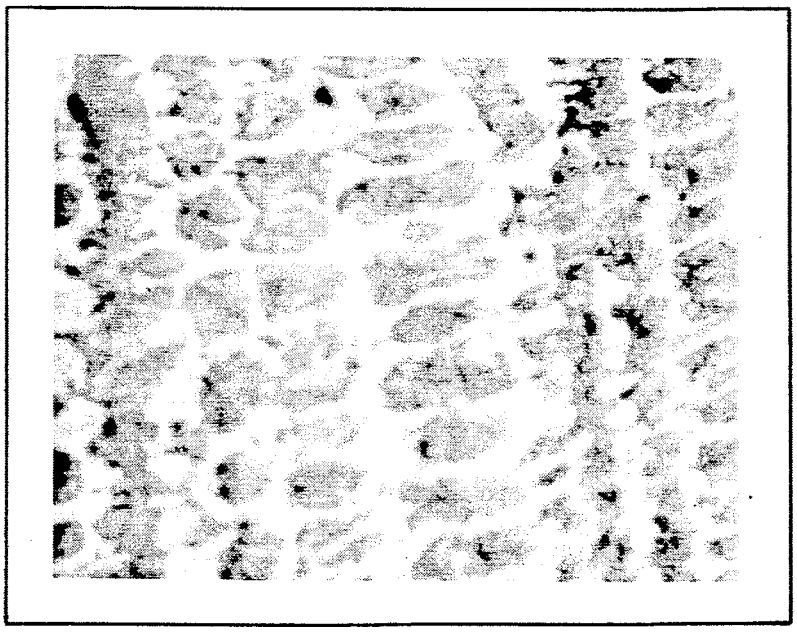

WEAR RESISTANT CAST IRON ROCKER ARM AND METHOD OF MAKING SAME

This is a division, of application Ser. No. 569,292, filed on Aug. 17, 1990, now U.S. Pat. No. 5,113,924.

FIELD OF THE INVENTION

The present invention relates to wear resistant cast iron machine components or elements, such as especially a rocker arm for an internal combustion engine, as well as a method of making same.

BACKGROUND OF THE INVENTION

A cast iron rocker arm used in an internal combustion engine is subjected to relatively high pressure, high speed rubbing against another cooperative component such as a cam lobe and/or valve stem. In some situations, the rocker arm wears rapidly as a result of friction and imperfect lubrication at the interface (contacting surfaces) between the rocker arm and the cooperative component.

One attempt at reducing wear of steel rocker arms and other wear-prone components has involved carburizing and/or nitriding to generate hard surfaces more resistant to wear. However, these surface hardening techniques add to the cost of the steel component and have not proven adequate in certain service applications.

An attempt at reducing wear of cast iron rocker arms has involved incorporating one or more metal chills in the casting mold at local regions corresponding to wear-prone areas of the casting to be formed. This technique has been used to cast rocker arms of a low alloy gray cast iron which is prone to form graphite in the microstructure depending upon the rate of cooling. The metal chill(s) accelerate the cooling rate and thus solidification of the iron at these local regions to essentially avoid formation of graphite and instead form a more wear resistant microstructure of iron carbides at the local regions. However, rocker arms cast in this manner will exhibit a complex microstructure having the carbidic constituent at the local, "chill-cast" regions and a graphitic constituent at other regions of the rocker arm.

Moreover, use of metal chill(s) in the casting of rocker arms not only adds to the cost of the final product but also results in dimensional variations that oftentimes necessitate subsequent extensive machining of the cast rocker arm to final tolerances.

Still another attempt at reducing wear of cast iron rocker arms has involved precision investment gravity casting of Cr-Ni alloy cast iron in preheated molds (e.g., 1800° F. shell molds). The Cr-Ni alloy cast iron develops an as-cast microstructure having desired carbide constituent(s) (e.g., iron carbides, chromium carbides, etc.) in the matrix upon solidification. Representative of these Cr-Ni alloy cast irons is the commercially available Nihard® cast iron available from International Nickel Company and having a nominal composition, in weight percent (w/o), of 3.0 w/o C, 0.60 w/o Si, 0.60 w/o Mn, 4.5 w/o Ni, 3.0 w/o Cr and balance Fe. These Cr-Ni alloy cast irons are very expensive and add to the cost of the cast rocker arms.

It is an object of the present invention to provide an economical cast iron machine component or element, such as especially a rocker arm, resistant to wear in the as-cast condition without the need for subsequent surface hardening treatments.

It is another object of the present invention to provide an economical cast iron machine component or element, such as especially a rocker arm, resistant to wear in the as-cast condition without the need for incorporating metal chills in the casting mold.

It is another object of the present invention to provide an economical low alloy or high alloy cast iron machine component or element, such as especially a rocker arm, resistant to wear in the as-cast condition.

It is still another object of the present invention to provide an economical method of casting a wear resistant, cast iron machine component or element, such as especially a rocker arm, that eliminates the need for metal chill(s) in the casting mold and subsequent (post-cast) surface hardening treatments.

SUMMARY OF THE INVENTION

The present invention contemplates a cast iron machine component or element, such as especially a rocker arm for an internal combustion engine, having a wear-resistant, as-cast microstructure throughout the body of the element wherein the as-cast microstructure comprises a dendritic constituent of, for example, austenite or transformed austenite (e.g., pearlite) depending upon alloy composition and an interdendritic carbide constituent, the as-cast microstructure being substantially free, preferably devoid, of graphite throughout the element. Typically, the interdendritic constituent comprises mixed carbides of Fe, Cr and Mo, the carbides of iron being predominant. Interdendritic ledeburite will also be present if the austenite remains untransformed.

The element (e.g., rocker arm) is formed of a low alloy or a high alloy cast iron that is differential pressure, countergravity cast into a "cold" (e.g., room temperature) ceramic investment shell mold in rapid manner and solidified in the "cold" shell mold sufficiently fast to produce the aforementioned wear-resistant, as-cast microstructure throughout the body of the casting. There is no need to use metal chill(s) in the mold to obtain the desired as-cast microstructure.

The method of the present invention for making the cast iron rocker arm or other machine element involves forming a cast iron melt, forming a mold (e.g., a ceramic investment shell mold) having at least one mold cavity shaped to produce the desired casting, and differential pressure, countergravity casting the cast iron melt at a predetermined casting temperature into the mold which is initially "cold" (e.g., at room temperature). Preferably, the casting temperature of the melt is selected to be not more than 300° F., preferably not more than 200° F., above the liquidus temperature of the cast iron. The melt is solidified rapidly in the mold by virtue of the initial "cold" temperature of the mold, the relatively low casting temperature (i.e., low superheat) of the melt and relatively small section thickness of the mold cavity to produce the wear-resistant, as-cast microstructure described hereinabove throughout the body of the casting.

The aforementioned objects and advantages of the invention will become more readily apparent from the following detailed description taken with the following drawings.

BRIEF DESCRIPTION OF THE DRAWINGS

FIG. 4 is a photomicrograph at 50× of the as-cast microstructure (etched using Vilella's etch) of a high alloy cast iron rocker arm cast in accordance with the invention at a casting temperature of 2575° F.

FIG. 5 is a photomicrograph at 400× of the as-cast microstructure of FIG. 4.

FIG. 9 is a photomicrograph at 50× of the as-cast microstructure (etched using Vilella's etch) of a low alloy cast iron rocker arm in accordance with the invention cast at 2500° F.

FIG. 10 is a photomicrograph of 400× of the as-cast microstructure of FIG. 9.

DETAILED DESCRIPTION OF THE INVENTION

Figure 1:
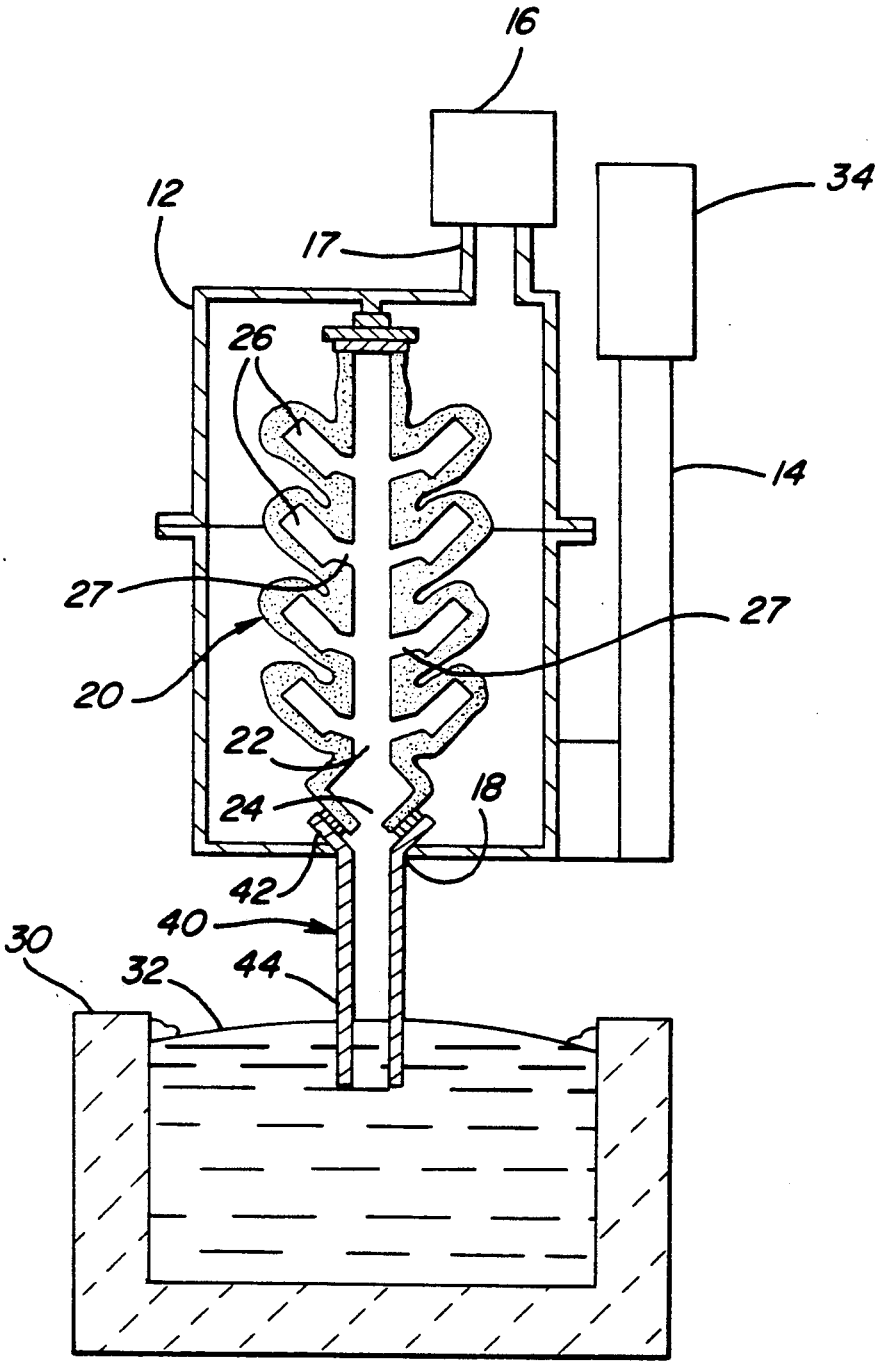
FIG. 1 is a schematic sectioned, side elevation of an apparatus for practicing the present invention.
Figure 2:
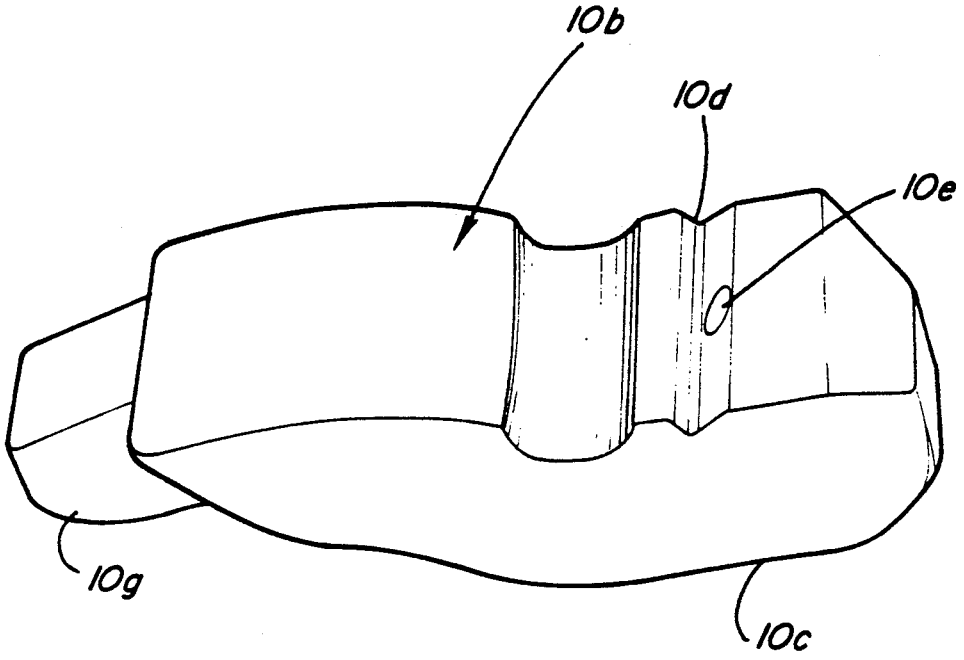
FIGS. 2 and 3 are perspective views illustrating opposite sides of a rocker arm cast in accordance with the invention.
Figure 3:
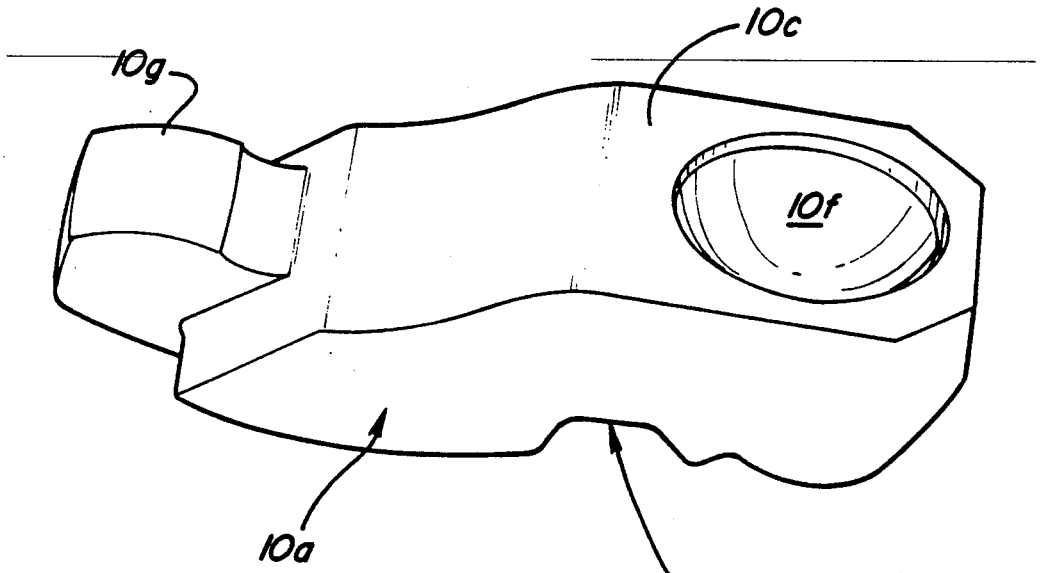

FIGS. 1 illustrates schematically an apparatus for practicing the invention to cast the rocker arm 10 shown in FIGS. 2–3 of an internal combustion engine. The rocker arm 10 includes an elongated cast body 10*a* having sides 10*b*, 10*c*. The rocker arm body 10 includes a groove 10*d* on side 10*b* to assist in providing oil lubrication through the hole 10*e* intersecting therewith, a concave recess 10*f* on side 10*c* to receive a hydraulic lash adjuster (not shown) of the internal combustion engine and an end extension 10*g* for controlling a valve (not shown) of the internal combustion engine. The rocker arm body 10*a* has a maximum thickness of about 0.4 inch, width of about 0.7 inch, length of about 2.1 inch and as-cast weight of about 0.14 lbs. (about 2.2 oz.).

Referring to Fig. 1, there is provided a partible, sealable vacuum container 12 mounted on vertically movable support 14. The container 12 has, in its upper wall, a connection 17 to differential pressure apparatus 16 (e.g., a vacuum pump) and, in its lower mold supporting wall, a central opening 18 for supporting a gas permeable mold 20 which is of the ceramic investment shell mold type disclosed in U.S. Pat. No(s). 3,863,706; 3,900,064 and 4,112,997. The gas permeable shell mold 20 includes a vertical passage 22 with a lower open end 24 for introducing iron melt 32 into each of a plurality of rocker arm-shaped mold cavities 26 therein. A crucible 30 for holding the iron melt 32 is disposed beneath the container 12. Differential pressure apparatus 16 can be selectively operated in the usual manner to apply a differential pressure between the container 12 (and thus mold 20) and the crucible 30 to urge the iron melt 32 upwardly through a fill pipe 40 into the mold 20 to fill the mold cavities 26 through vertical mold passage 22 and lateral ingates 27. A hydraulic power cylinder 34 connected to movable support 14 is provided for relatively moving the crucible 30 and the mold-containing container 12 to immerse the metal fill pipe 40 in the iron melt 32 preparatory to casting and to withdraw the fill pipe 40 after casting. Casting apparatus of the general type described is well known; e.g., as shown in U.S. Pat. No. 4,791,977 the teachings of which are incorporated herein by reference.

Low alloy and high alloy cast iron compositions may find use in the present invention. Generally, the low alloy cast iron composition will include at least about 3.0% by weight C, at least about 2.0% by weight Si and at least about 0.5% by weight Cr as well as other various alloyants. The high alloy cast iron composition will generally include at least about 2.4% by weight C, at least about 0.5% by weight Si and at least about 18.0% by weight Cr for desired corrosion resistance.

In the low alloy cast iron, Si is present in an amount of at least about 2.0% by weight to impart desired castability (fluidity) to the molten iron melt 4, especially when cast at the relatively low superheats involved in the invention as will be explained hereinbelow. In low alloy cast irons, Cr counteracts the tendency of Si over about 2.0% by weight to effect graphite formation during solidification. To this end, the ratio of Cr to Si preferably is about 0.38 to about 0.52. In both the low alloy and high alloy cast irons, the Cr fosters nucleation of iron carbides (cementite) and inhibits graphite formation during solidification. The lower limit of the C content in both the low alloy and high alloy cast irons is selected to insure desired carbide precipitation during solidification while the upper limit is restricted to avoid graphite formation and excessive (embrittling) carbide precipitation during solidification. The hardenability of the cast iron composition, whether a low alloy or high alloy cast iron composition, is also affected by the presence of Mn, Mo, Ni and Cr and, if present, their concentrations in the cast iron composition are controlled to this end.

In countergravity casting the rocker arms 10 in accordance with the invention, the container 12 (engaged with the mold 20) is moved downwardly (by operation hydraulic power cylinder 34) to immerse the lower end of the fill pipe 40 in the iron melt 32. A reduced pressure (e.g., 6 psia) is then established in the container 12 and so to the mold 20 by operation the differential pressure device 16 (e.g., the vacuum pump) to draw the iron melt 32 upwardly through the fill pipe 40, through the central vertical passage 22, through the narrow lateral ingates 23 and into the rocker arm-shaped mold cavities 26 to fill them with the melt 32. As a result of the differential pressure established between the mold cavities 26 and the iron melt 32, the mold cavities 26 are filled rapidly; e.g., typically in about 2 seconds. This "instant" filling of the mold cavities 26 is beneficial in the present invention in achieving the desired as-cast microstructure for the cast rocker arm(s) 10.

Importantly, in accordance with the invention, the initial temperature of the casting mold 20 is maintained at a sufficiently low, "cold" temperature during filling with the iron melt 32 to provide rapid cooling of the melt after it is cast into the mold cavities 26 so as to yield the desired wear-resistant, graphite-free, as-cast microstructure to be described in detail hereinbelow. Typically, such a "cold" mold temperature will be at least about 2000° F. below the casting temperature of the iron melt 32. Preferably, the casting mold 20 is initially at room temperature (e.g., about 70 to about 100° F.) when the iron melt 4 is countergravity cast into the mold 20.

However, the initial mold temperature may be maintained above room temperature by limited mold preheating prior to casting of the iron melt 32 therein. For example, initial mold temperatures above room temperature but less than about 800° F. (e.g., 200° F., 400° F. or 600° F.) may possibly be used to cast the rocker arm(s) 10 depending upon the composition of the melt 32, its casting temperature and the dimensions of the rocker arm. However, a casting mold temperature of room temperature is preferred nevertheless to provide a finer cast microstructure, and a more convenient, economical casting process and cast part.

In conjunction with use of the casting mold 20 at room temperature, the casting temperature of the iron melt 32 is preferably controlled (limited) to be about 200° F. above its liquidus temperature. That is, a low melt superheat is employed. For example, for a low alloy cast iron melt 32, a casting temperature of about 2500° F. has been employed and yielded the best results in terms of an as-cast microstructure having fine dendritic/interdendritic constituents. For a high alloy (e.g., 19 weight % Cr) cast iron melt, a casting temperature of about 2575° F. has been successfully used to achieve a desired wear resistant, as-cast microstructure.

However, higher casting temperature (i.e., higher superheat) can be employed and still achieve an acceptable wear-resistant, as-cast microstructure for some intended service applications. For example, the low alloy iron melt 32 described hereinabove was also countergravity cast into a room temperature mold 20 at a casting temperature of 2800° F. and yielded a wear resistant, graphite-free, as-cast microstructure.

Those skilled in the art will appreciate that both the initial mold temperature and the casting temperature employed in practicing the invention are "part dependent"; i.e., the temperatures selected will vary with the size, shape and weight of the cast part as well as the particular iron composition being cast.

Rocker arms or other machine elements having a size, shape and weight and cast from an iron composition different from those described hereinabove may involve a different initial mold temperature and casting temperature, although room temperature molds 20 are preferred in most situations.

The relative vacuum established in the container 12 is maintained for about twenty (20) seconds after the mold cavities 26 have been filled with the iron melt 32. During this time, the melt 32 in the lateral ingates 27 and the mold cavities 26 solidifies. The container 12 and mold 20 engaged thereto are then raised to withdraw the fill pipe 40 out of the melt 3. During withdrawal of the fill pipe 40, still molten melt 32 in the passage 22 and the fill pipe 40 drains back into the crucible 30 for reuse.

As a result of the initial "cold" temperature (e.g., room temperature) of the casting mold 20 in conjunction with the relatively low casting temperature (i.e., low superheat) of the iron melt 32 in the crucible and the small cross-section thickness of the mold cavities 26 (preferably less than about 0.5 inch in cross-sectional thickness), the iron melt filling the mold cavities 26 solidifies rapidly therein. For example, for the rocker arm(s) 10 and the low alloy or high alloy iron melt 32 referred to above, solidification of the melt in the ingates 27 and mold cavities 26 typically occurs within about 10 seconds to about 15 seconds after the mold cavities 26 are filled with the melt.

The rate of solidification (rate of cooling) is sufficiently fast to yield a wear-resistant, as-cast microstructure comprising a fine dendritic constituent of austenite or transformed austenite (e.g., pearlite) depending upon alloy composition and an interdendritic carbide constituent, the microstructure being substantially free of graphite. Preferably, the as-cast microstructure is totally devoid of graphite. Interdendritic ledeburite will also be present if the austenite remains untransformed. This microstructure is present throughout the entire body 10*a* of the cast rocker arm. Typically, the initial cooling rate of the melt in the mold cavities 26 is greater than 1800° F./min., preferably about 2000° F./min. under these casting conditions.

Referring to FIGS. 4 and 5, a typical wear resistant, graphite-free, as-cast microstructure produced in accordance with the invention in a high alloy cast iron rocker arm is shown. The high alloy cast iron rocker arm was cast in accordance with Example 1 from a high alloy cast iron composition consisting essentially of about 2.4 to about 2.9% by weight C, about 0.5 to about 0.7% by weight Si, about 1.3 to about 1.5% by weight Mn, about 18 to about 20% by weight Cr, up to about 0.2% by weight P, up to about 0.1% by weight S and the balance essentially Fe.

Figure 6:
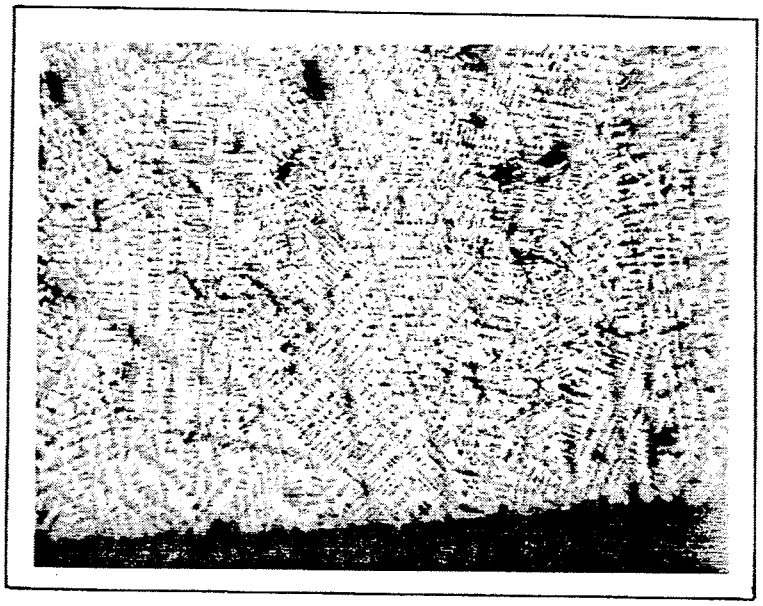
Fig-6 PRIOR ART
FIG. 6 is a photomicrograph at 50× of the as-cast microstructure (etched using Vilella's etch) of the high alloy cast iron rocker arm that was gravity cast in a hot (e.g., 1800° F.) mold.
Figure 7:
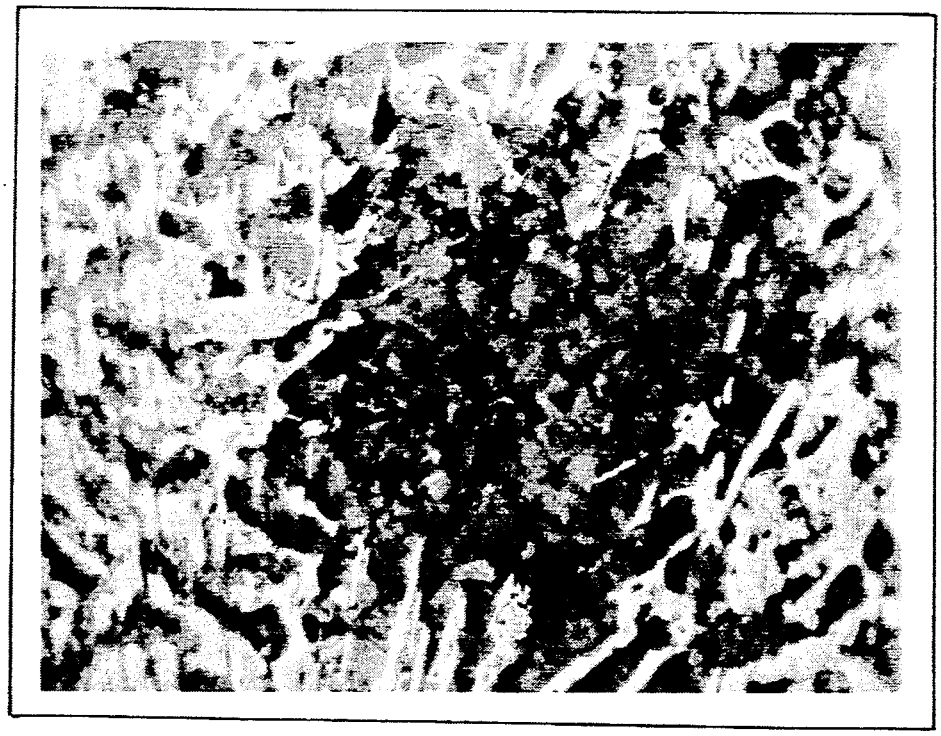
Fig-7 PRIOR ART
FIG. 7 is a photomicrograph at 400× of the as-cast microstructure of FIG. 6 showing a pearlite colony around a graphite flake.
Figure 8:
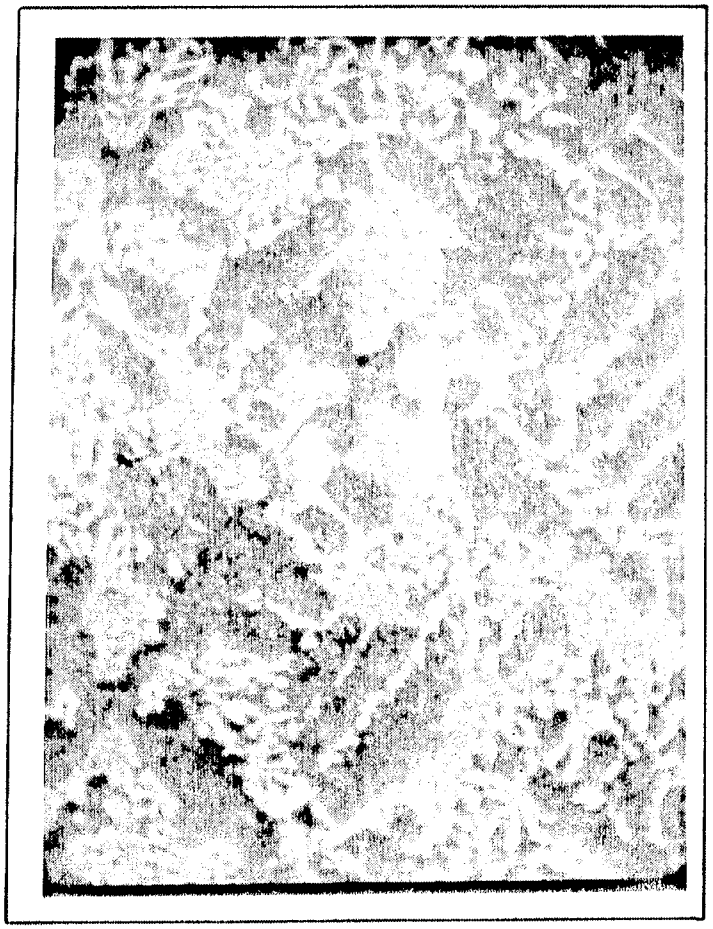
Fig-8 PRIOR ART
FIG. 8 is a photomicrograph at 400× of the as-cast microstructure of FIG. 6.

The microstructure of FIGS. 4–5 can be compared to the microstructure of FIGS. 6–8 obtained from rocker arms that were gravity cast of the same high alloy iron composition into hot (preheated) ceramic investment molds (about 1800° F. mold temperature). The microstructure of FIGS. 6–8 is not satisfactory due to the graphite (one graphite flake encircled) present. In this microstructure, patches or colonies of pearlite surround the graphite flakes as shown best in FIG. 7.

Moreover, the microstructure of FIGS. 6–8 has a much coarser and less oriented dendritic structure than the microstructure of FIGS. 4–5 of the invention. The secondary dendrite arm spacing of the microstructure of FIGS. 4–5 is about ½ that of the microstructure of FIGS. 6–7.

A dendritic constituent of austenite (non-lamellar, dark constituent in FIGS. 4–5) results from relatively rapid cooling and solidification of the iron melt 32 in the initially "cold" mold 20. Interdendritic ledeburite and carbides are present in the as-cast microstructure. As is well known, ledeburite constitutes the eutectic of the iron-carbon system, the mixed phases being austenite and cementite. Ledeburite is a lamellar interdendritic constituent in FIG. 5.

The interdendritic carbide constituent typically includes mixed carbides of Fe, Cr and Mo depending upon the particular carbide formers present in the cast iron composition. In any event, iron carbides (cementite) constitute a significant portion, such as at least about 25% by volume (e.g., about 34% by volume) of the interdendritic carbide constituent of the high alloy cast iron rocker arm of the invention.

A trace (e.g., 5 volume %) of pearlite may be present in the as-cast microstructure of the high alloy cast iron rocker arm.

Referring to FIGS. 9 and 10, a typical wear resistant, as-cast, graphite-free microstructure produced in accordance with the invention in a low alloy cast iron cast rocker arm is shown. The low alloy cast iron rocker arm was cast in accordance with Example 2 from a low alloy cast iron composition consisting essentially of about 3.0 to about 3.2% by weight C, about 2.1 to about 2.4% by weight Si, about 0.7 to about 0.9% by weight Mn, about 0.4 to about 0.7% by weight Ni', about 0.9 to about 1.10% by weight Cr, about 0.4 to about 0.7% by weight Mo, up to about 0.2% by weight P, up to about 0.1% by weight S and the balance essentially iron. This composition is referred to as a low alloy cast iron in that the total percentage of Mn, Cr, Mo and Ni does not exceed about 5.0% by weight of the composition.

The as-cast microstructure of FIGS. 9–10 comprises a fine dendritic constituent of transformed austenite (e.g., pearlite-dark constituent) and an interdendritic constituent of mixed carbides of Fe, Cr and Mo (light constituent). The iron carbides constitute about 33% by volume of the interdendritic carbide constituent. Moreover, the microstructure is devoid of graphite. This as-cast microstructure is present throughout the entire body of the cast rocker arm.

After solidification and removal from the mold 20, the cast iron rocker arm(s) 10 typically require only minor machining of areas of side 10*b* since very close dimensional control is achievable by countergravity casting the rocker arms in ceramic investment shell molds in accordance with the invention. The rocker arm(s) 10 of the invention can be installed for service in the internal combustion engine without the need for any post-cast surface hardening treatment (such as carburizing/nitriding). Moreover, no metal chills are required in casting the rocker arm(s) 10 in accordance with the invention. Optionally, the as-cast rocker arms may be heat treated, quenched and tempered (prior to machining) to further enhance the hardness of the microstructure. For example, the high alloy cast iron casting of Example 1 can be loaded into a furnace initially maintained at 1000° F. The furnace temperature is raised to heat the casting to 1750° F. for one hour to austenitize the as-cast microstructure. Then, the heated casting is removed from the furnace and oil quenched to ambient and tempered at 500° F. for 4 hours after quenching. The oil quench is effective to transform the austenitic dendrites to harder martensite. The low alloy cast iron casting of Example 2 can be loaded into the furnace maintained initially at 1000° F. and heated to 1575° F. for 15 minutes, oil quenched and tempered at 400° F. for 4 hours.

As is apparent hereinabove, the rocker arms can be cast in accordance with the invention from low alloy cast iron compositions or high alloy cast iron compositions. In some situations, rocker arms cast from high alloy cast iron can be designed with reduced dimensions to reduce the weight and thus the cost of the high alloy cast iron rocker arms.

High alloy cast iron rocker arm(s) 10 having the as-cast microstructure of FIGS. 4–5 throughout the body 10*a* thereof exhibited a $R_c$ hardness of about 52 while low alloy cast iron rocker arms having the microstructure of FIGS. 9–10 exhibited a $R_c$ hardness of about 58–59. When heat treated, quenched and tempered as described above, the $R_c$ hardnesses of both the high alloy and low alloy rocker arms were about 58–62. These heat treated/quenched/tempered high alloy and low alloy rocker arms have been subjected to automobile engine run tests at an automobile manufacturer using burnt oil and have exhibited satisfactory wear resistance in the test, evidencing only minimal wear after 200 hours in test. Moreover, these rocker arms 10 have been subjected to break tests wherein an elongated specimen is subjected to three (3) point loading; namely, at the opposite ends and at the middle of the specimen. The rocker arms 10 of the invention exhibited a 45% higher breaking load than chilled cast iron rocker arms (i.e., rocker arms cast using metal chills) of the same general iron composition and a 100% higher breaking load than rocker arms having the as-cast microstructures shown in FIGS. 6 and 7. This improvement in breaking load results is achievable in the as-cast condition as well as the as-cast/heat treated/quenched/tempered condition.

The following Examples are offered to further illustrate, but not limit, the present invention:

EXAMPLE 1

A high alloy cast iron melt (2.6 weight % C, 0.5 weight % Si, 1.3 weight % Mn, 19.1 weight % Cr and balance essentially iron and incidental P and S impurities) was prepared and vacuum countergravity cast at a melt temperature of 2575° F. into a room temperature ceramic (e.g., mullite) investment shell mold having a mold wall thickness of about ¼ inch. The shell mold included 140 rocker arm-shaped mold cavities disposed about a central riser (e.g., see FIG. 1). A vacuum of 18 inches of Hg was used to countergravity cast the melt into the mold after its fill tube was immersed in the melt. The mold cavities were filled with melt in about 2 seconds. The vacuum was maintained in the vacuum container (12) for about 20 seconds while the mold fill tube remained immersed in the melt. The melt in the mold cavities solidified during this time (cooling rate of about 2000° F./min). After 20 seconds, the vacuum was released (ambient pressure provided in the vacuum container) and the mold was withdrawn from the melt. The mold was removed from the vacuum container and air cooled to room temperature. The rocker arms produced in this way exhibited the wear-resistant, graphite-free, as-cast microstructure shown in FIGS. 4–5. If desired, the austenitic dendrites can be transformed to martensite by heat treating/quenching/tempering the rocker arms as described above to increase rocker arm hardness.

EXAMPLE 2

A low alloy cast iron melt (3.05 weight % C, 2.17 weight % Si, 0.8 weight % Mn, 0.47 weight % Mo, 0.46 weight % Ni, 1.04 weight % Cr and balance essentially iron and incidental P and S impurities) was prepared and vacuum countergravity cast at a melt temperature of 2500° F. into a room temperature ceramic (e.g., mullite) investment shell mold having a mold wall thickness of about ¼ inch. The shell mold included 140 rocker arm-shaped mold cavities disposed about a central riser (e.g., see FIG. 1). A vacuum of 18 inches of Hg was used to countergravity cast the melt into the mold after its fill tube was immersed in the melt. The mold cavities were filled with melt in about 2 seconds. The vacuum was maintained in the vacuum container for about 20 seconds while the mold fill tube remained immersed in the melt. The melt in the mold cavities solidified during this time (cooling rate of about 2000°/min). After 20 seconds, the vacuum was released (ambient pressure established in the vacuum container) and the mold was withdrawn from the melt. The mold was removed from the vacuum container and air cooled to room temperature. The rocker arms produced in this way exhibited the wear resistant, graphite-free, as-cast microstructure shown in FIGS. 9–10. If desired, the rocker arms may be subjected to the heat treat/quench/temper treatment as described above to increase hardness.

While the invention has been described in terms of specific embodiments thereof, it is not intended to be limited thereto but rather only to the extent set forth in the claims which follow.

I claim:

1. A cast iron rocker arm for an internal combustion engine, said rocker arm having a body with wear resistant, as-cast microstructure throughout said body, said as-cast microstructure comprising a dendritic constituent and an interdendritic carbide constituent, said as-cast microstructure being substantially free of graphite throughout said body.

2. The rocker arm of claim 1 comprising a low alloy cast iron including Si in an amount of at least about 2.0% by weight, Cr in an amount of at least about 0.5% by weight and carbon in an amount of at least about 3.0% by weight.

3. The rocker arm of claim 2 wherein the Cr content does not exceed about 5% by weight.

4. The rocker arm of claim 2 wherein the ratio of Cr/Si is about 0.38 to about 0.52.

5. The rocker arm of claim 1 comprising a high alloy cast iron including Cr in an amount of at least about 18.0% by weight and carbon in an amount of at least about 2.4 % by weight.

6. The rocker arm of claim 1 cast by differential pressure, countergravity casting of the cast iron in the molten condition upwardly into a room temperature ceramic shell mold.

7. A cast iron rocker arm for an internal combustion engine, said rocker arm having a body consisting essentially of about 3.0% by weight to about 3.2% by weight C, about 2.1% by weight to about 2.4% by weight Si, about 0.7% by weight to about 0.9% by weight Mn, about 0.4% by weight to about 0.7% by weight Mo, about 0.4% by weight to about 0.7% by weight Ni, about 0.9% by weight to about 1.10% by weight Cr, up to about 0.2% by weight P, up to about 0.1% by weight S and the balance Fe, said body having a wear-resistant, as-cast microstructure throughout said body, said as-cast microstructure comprising a dendritic constituent of transformed austenite and an interdendritic constituent of carbides of Fe and Cr, said as-cast microstructure being substantially free of graphite throughout said body.

8. A cast iron rocker arm for an internal combustion engine, said rocker arm having a body consisting essentially of about 2.4 to about 2.9% by weight C, about 0.5 to about 0.7% by weight Si, about 1.3 to about 1.5% by weight Mn, about 18 to about 20% by weight Cr, up to about 0.2% by weight P, up to about 0.1% by weight S and the balance iron, said body having a wear-resistant, as-cast microstructure throughout said body, said as-cast microstructure comprising a dendritic constituent of austenite and interdendritic constituents of ledeburite and carbides of Fe and Cr, said as-cast microstructure being substantially free of graphite throughout said body.

* * * * *